United States Patent [19]

Erickson

[11] Patent Number: 4,643,281

[45] Date of Patent: Feb. 17, 1987

[54] CARRYING CASE

[76] Inventor: Kenneth E. Erickson, R.R. #13 Lakeshore Drive, Thunder Bay, Canada, P7B 5E4

[21] Appl. No.: 830,341

[22] Filed: Feb. 18, 1986

[51] Int. Cl.[4] ..... A45C 3/00; A45C 13/10; E05B 65/50

[52] U.S. Cl. ..... 190/119; 190/109; 190/112; 190/900; 292/DIG. 42; 292/DIG. 48

[58] Field of Search ..... 190/100, 109, 111, 114, 190/119, 112, 900, 901, 121; 150/52 B; 292/DIG. 42, DIG. 48

[56] References Cited

U.S. PATENT DOCUMENTS

| | | | |
|---|---|---|---|
| 513,726 | 1/1894 | Potts | 190/109 X |
| 722,317 | 3/1903 | Moody | 190/112 X |
| 803,094 | 10/1905 | Christie | 190/111 X |
| 1,814,336 | 7/1931 | Ritter, Jr. | 190/109 X |
| 1,980,714 | 11/1934 | Brady | 190/109 X |
| 2,025,101 | 12/1935 | Halpin | 190/119 X |
| 4,265,286 | 5/1981 | Rapoport | 190/119 X |
| 4,386,642 | 6/1983 | Durbin | 190/114 X |

FOREIGN PATENT DOCUMENTS

| | | | |
|---|---|---|---|
| 3418234 | 11/1984 | Fed. Rep. of Germany | 190/109 |
| 2007193 | 5/1979 | United Kingdom | 190/109 |
| 2149001 | 6/1985 | United Kingdom | 190/121 |

*Primary Examiner*—William Price
*Assistant Examiner*—Sue A. Weaver
*Attorney, Agent, or Firm*—Burke-Robertson, Chadwick & Ritchie

[57] ABSTRACT

A carrying case such as an attache case or the like, in which one of its panels is foldable to provide access to its interior without having to open the entire panel. A clamp means secured to the side of the case swivels between two positions, one to hold the panel rigid and prevent it from folding, and the other to hold one portion of the panel closed and permit the other portion to fold open. The carrying case according to the present invention permits access to the interior of the case without having to open the case entirely, thereby significantly increasing its versatility over a standard carrying case.

12 Claims, 4 Drawing Figures

CARRYING CASE

BACKGROUND OF THE INVENTION

The present invention relates to improvements in carrying cases such as attache cases.

Carrying cases of the type in question normally have planar front and back panels, each with circumscribing rigid top, bottom and side edges extending towards the other panel to provide, when in closed position, a completely enclosed interior volume. The carrying case is normally opened by pivoting the front and back panels about the junction of the bottom edges, in clam shell fashion. Appropriate clasps are provided, normally secured to the top edges of the case, to hold the panels in closed position. A carrying handle is usually secured centrally to one of the top edges.

U.S. Pat. No. 722,317 issued Mar. 10, 1903 to W. A. Moodie describes and illustrates a carrying case of the type in question in which a fold line is provided in the front panel, parallel to the top and bottom edges. In this way, both upper and lower parts together may be opened or, by providing suitable clasps, the lower part of the front panel may be held securely while the upper part is opened. Such a construction, while acceptable for a suitcase or such a large piece of luggage which may only be infrequently used or opened, is not particularly well suited to a carrying case such as an attache case which would be frequently opened. With an attache case, the user may frequently not require or want the front panel to fold each time the case is opened.

Thus, it is an object of the present invention to provide such a carrying case having a front panel which may, as required, be folded to open just a portion of the case, or remain unfoldable, so that the entire panel moves to open the case.

SUMMARY OF THE INVENTION

The present invention relates specifically to a carrying case of the type having rectangular planar front and back panels, each having circumscribing rigid top, bottom and side edges, extending towards the other panel to provide, when in closed position, a completely enclosed interior volume, the front and back panels pivoting about the junction of the bottom edges between open and closed positions, closure means secured to the top edges of the panels to hold the panels in closed position against unintended opening and a handle secured centrally to one of the top edges.

In accordance with the invention, the front panel is hinged along a fold line parallel to its top and bottom edges and spaced preferably, centrally, therebetween. This line divides the front panel into upper and lower portions. The continuity of each of the side edges of the front panel is broken by a cut at the fold line, to form a lower and an upper portion of the side edge and permit folding of the front panel about the line. A clamp means is secured to the lower portion of an exposed side edge of the front panel to swivel between one position extending across the cut of that side edge to releasably engage an engaging means mounted on the upper portion of that side edge of the front panel and a second position extending to the corresponding side edge of the back panel to releasably engage an engaging means mounted there. The clamp means, front panel side edge mounted engaging means and cut of the front panel side edge are such that when the clamping means engages this side edge mounted engaging means the front panel maintains its planar shape and is prevented from folding. The clamp means and back panel side edge mounted engaging means are such that when the clamp means engages this engaging means, the lower portion of the front panel is held in closed position with respect to the back panel but the upper portion of the front panel is free to fold thereby providing access to the interior volume of the carrying case.

In a preferred embodiment of the present invention, the carrying case is further provided with support means which is associated with the upper portion of the front panel. The support means co-operates with the back panel to maintain the upper portion of the front panel folded at a predetermined angle with respect to the lower panel so that the carrying case can function in a podium-like fashion. Also, the carrying case may be provided with a pocket having a rear surface, for the interior surface of the front or back panels. The inner surface of the front and back panels and the rear surface of the pocket may preferably be provided with means for releasably attaching the pocket at predetermined areas on the interior surfaces of the front or back panels.

The carrying case in accordance with the present invention provides significant versatility for certain situations. When the clamp means is in position to permit opening of only the upper portion of the front panel, the case may be opened, even while sitting on its bottom edges, without any danger of its contents spilling out. This provides, nevertheless, easy access to the interior of the carrying case and its contents. The full "clam shell" opening of the attache case, which normally requires the case being opened while resting on its back panel, is thereby avoided or made unnecessary. As well, where space is at a premium, such as when the user of the carrying case is sitting as a passenger on an airplane seat, the ability to gain access to the carrying case (whether the case is on the floor, upright on its edges, or flat on one's lap) without having to open the entire front panel is extremely advantageous. With the upper portion of the front panel open, while the bottom portion thereof is secured in closed position, the case can be moved by its handle while thus "open". In other words, the case could be standing on its edges and could be lifted down and placed in a similar position on the floor without having to close the upper portion of the front panel. Easy access to its contents are provided while the case is in this position on the floor, unlike conventional attache cases. The carrying case according to the present invention can also act as a stand-up file holder on a desk, keeping files accessible, readable and in order until the user is ready to transport them.

BRIEF DESCRIPTION OF THE DRAWINGS

These and other advantages and objects of the invention will become apparent upon reading the following detailed description and upon referring to the drawings in which.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE DRAWINGS

Figures 1, 2, 3:
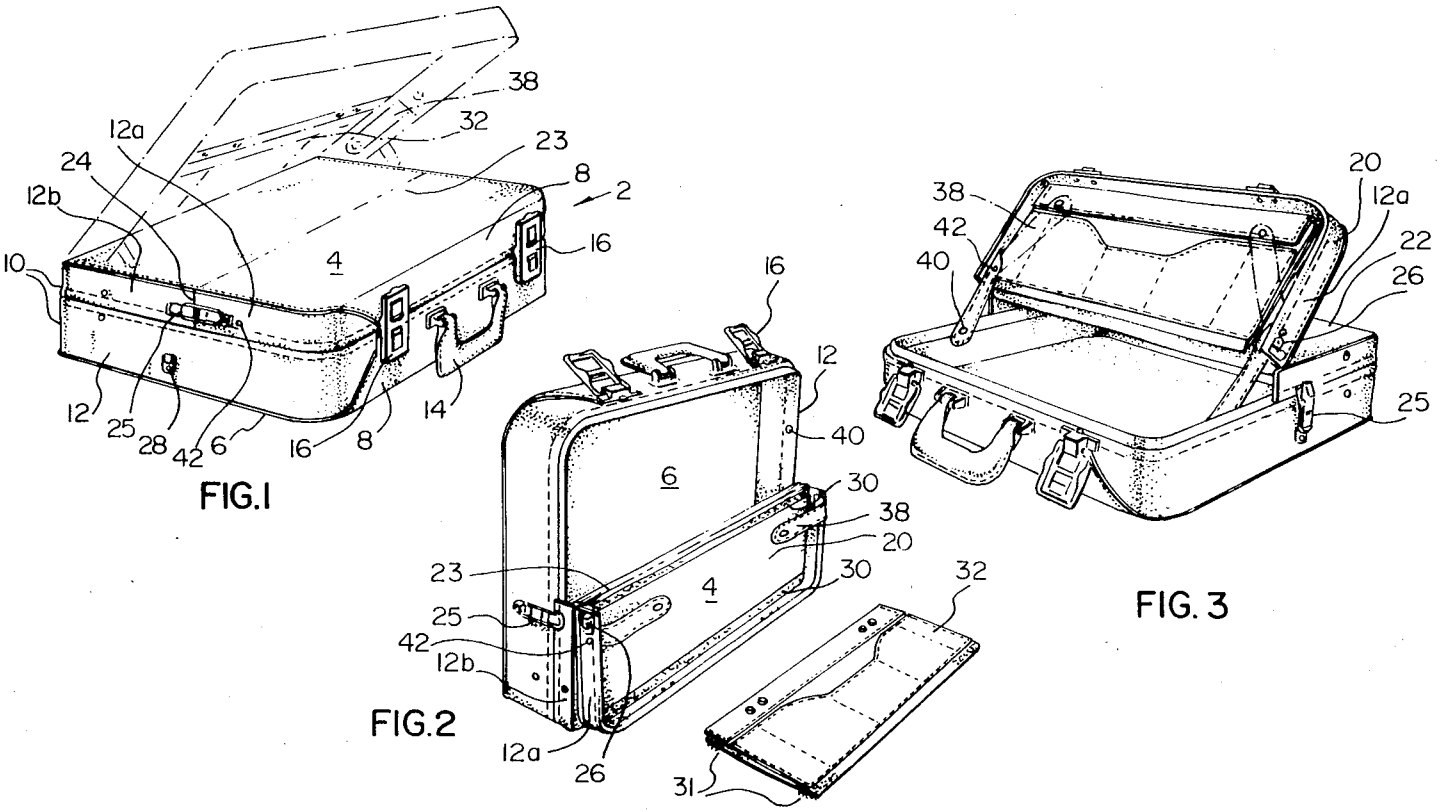
FIG. 1 is a perspective view of a carrying case in accordance with the present invention in which the clamp means is shown in position for traditional carrying case construction.
FIGS. 2 and 3 are perspective views of the carrying case of FIG. 1 in which the clamp means has been positioned to permit a portion of the front panel to be folded open.

Turning to the drawings, there is shown in FIG. 1 an attache case 2 in accordance with the present invention. The attache case has planar front and back panels 4 and 6 respectively, circumscribed by top edges 8, bottom edges 10 and side edges 12. The edges on each panel are normal to its surface and extend towards the other panel to provide, when in closed position as illustrated in full line in FIG. 1, a closed interior volume. As shown in phantom in FIG. 1, the front panel 4 pivots, relative to back panel 6, about an axis along the junction of bottom edges 10 from closed position (line) to open position (phantom). A handle 14 is secured centrally to the top edge 8 of back panel 6. Appropriate clasps 16 are provided to hold the panels 4 and 6 in closed position.

As can be seen best in FIGS. 2 and 3, top panel 4 is hinged along a line 23 parallel to its top and bottom edges, which line is centrally spaced and divides the front panel into an upper portion 20 and a lower portion 22. The continuity of the side edges 12 of front panel 4 is broken by cut 24 (FIG. 1) thereby forming an upper portion 12*a* and a lower portion 12*b* of each side edge.

Figure 4:
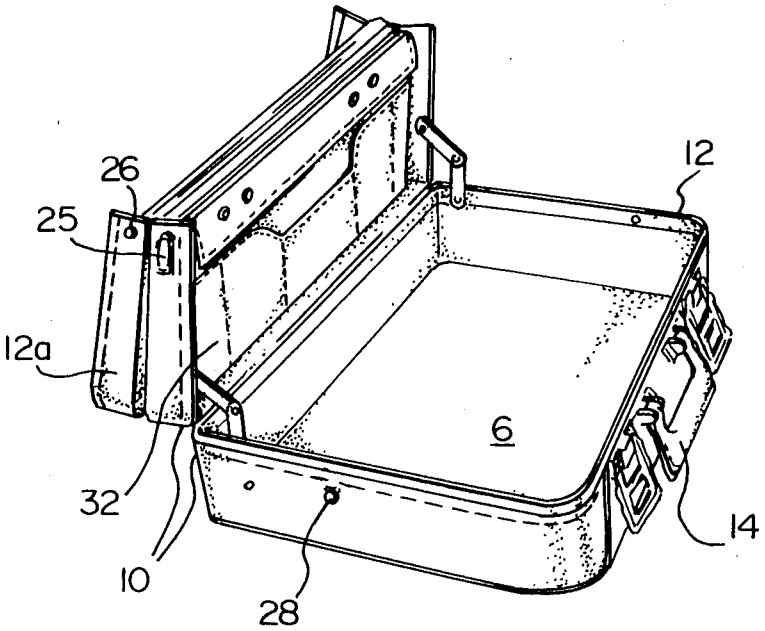
FIG. 4 is a perspective view of the carrying case of FIG. 1 in which the front panel has been fully opened while in folded condition.

An appropriate clamp means, such as a clasp 25 is secured to each side edge 12*b* of upper panel 4. As shown in FIG. 1 this clasp extends across cut 24 to upper side portion 12*a* where it is shown engaging extension 26 (FIG. 2). In this position, the clasp prevents upper panel 4 from folding about hinge line 23 and the planar shape of the front panel is maintained even when the panel is open (phantom, FIG. 1). Clasp 25 also pivots, however, about its base secured to lower side edge 12*b*, to the position in FIGS. 2 and 3 where it engages extension 28 (FIG. 1) on the corresponding side edge of lower panel 6. When the clasp engages extension 28 as illustrated in FIGS. 2 and 3, the lower portion 22 of front panel 4 is held in closed position as illustrated, with respect to back panel 6, but upper portion 20 of front panel 4 is free to fold about line 23. Thus, if clasp 25 is in position as illustrated in FIGS. 2 and 3, the attache case 2 may be partially opened by undoing clasps 16 and folding upper portion 20 about line 23. Files or papers in the interior of attache case 2 are thereby prevented from falling out of case 2 by lower portion 22 when the attache case is in the upright position as illustrated in FIG. 2. When the case is in this position, files are more readily accessible than when the case is lying flat on its back panel 6, since it acts like a portable filing cabinet. Nevertheless access to such files or papers is still permitted. The attache case may also be opened in a similar manner when resting on bottom panel 6 (FIGS. 3 or 4) without having to open all of upper panel 4. When the case is opened in this manner while it is lying flat, the usual "clam-like" lid sticking up in the air may be avoided.

By providing for example a hook receiving fabric lining for the interior surfaces of panels 4 and 6, as illustrated by fabric strips 30 in FIG. 2, and releasable hooks 31 for engaging with fabric 30 (e.g. VELCRO [trade mark] construction) the backing of pocket structure 32, removable or rearrangable pockets 32 may be provided for the attache case, further enhancing its versatility. Pocket structure 32 may alternatively be attached using snap fasteners, appropriate zippers or any other releasable fastening means. These pockets may be arranged on, for example, the interior surface of upper panel 20 (FIG. 3) or elsewhere if and as required on one of the interior panel surfaces of the attache case.

A further optional feature of the carrying case 2 according to the present invention are the support straps 38 illustrated in FIG. 3. These support straps may be secured, for example, to the interior surface of side edges 12*a* of upper portion 20 of upper panel 4 as illustrated, and may be releasably attachable to dome fasteners 40 or the like on the interior surface of side edges 12 of lower panel 6, to hold upper portion 20 of front panel 4 at an angle upwardly to the plane of panel 6. This provides a lectern-like structure for the attache case, which may be convenient, for example, for purposes of reading while seated in an aircraft or the like. Straps 38 are preferably secured to upper panel 4 by means of swivel attachments 42 so that, when not in use to hold upper portion of front panel 4 as illustrated in FIG. 3, they may be releasably secured to corresponding dome fasteners 40 on pocket structure 32 to assist in securing it in any of its alternative positions as seen in, for example, FIGS. 1 and 3.

Thus it is apparent that there has been provided in accordance with the invention a carrying case that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a carrying case having rectangular planar front and back panels, each having circumscribing, rigid top, bottom and side edges extending towards the other panel to provide, when the panels are in closed position, a completely enclosed interior volume, the front and back panels pivoting about an axis along the junction of the bottom edges between open and closed positions, closure means secured to the top edges of the panels to hold the panels in closed position against unintended opening, and a handle means secured centrally to one of the top edges, the improvement characterized by the front panel being hinged along a fold line parallel to its top and bottom edges and spaced therebetween, this line dividing the front panel into an upper and lower portion, the continuity of each of the side edges of the front panel being broken by a cut at the fold line to form a lower and an upper portion of said side edge and permit folding of this front panel about said line, and a clamp means secured to the lower portion of an exposed side edge of the front panel to swivel between one position extending across the cut of that side edge to releasably engage an engaging means mounted on the upper portion of that side edge of the front panel and a second position extending to the corresponding side edge of the back panel to releasably engage an engaging means mounted on said side edge of the back panel, the clamp means, front panel side edge mounted engaging means and cut of the front panel side edge being such that when the clamping means engages this side edge mounted engaging means the front panel maintains its planar shape and is prevented from folding, and the clamp means and back panel side edge mounted engaging means being such that when the clamp means engages this engaging means, the lower portion of the front panel is held in closed position with respect to the back panel but the upper portion of the front panel is free to fold thereby providing access to the interior volume of the carrying case.

2. A carrying case according to claim 1 wherein both sides of the carrying case are provided with clamp means, front panel side edge mounted engaging means and back panel side edge mounted engaging means.

3. A carrying case according to claim 1 wherein the handle is secured to the top edge of the back panel.

4. A carrying case according to claim 1 wherein the hinge line of the front panel is centrally positioned on the panel between the top and bottom edges.

5. A carrying case according to claim 1 further provided with support means associated with the upper portion of the front panel, the support means to co-operate with the back panel to maintain the upper portion of the front panel folded at a predetermined angle with respect to the lower portion.

6. A carrying case according to claim 5 wherein a pocket means having a rear surface is provided for the interior surface of the front or back panels, predetermined inner surfaces of the front and back panels and the rear surface of the pocket means being provided with means for releasably attaching the pocket means at predetermined areas on the interior surfaces of the front or back panels.

7. A carrying case according to claim 6 wherein the support means comprises a support strap pivotally secured to the interior surface of each side edge of the upper portion of the front panel, the free end of each support strap having securing means co-operating with corresponding securing means secured to the interior surface of the side edges of the back panel to releasably secure the straps thereto, the support straps being pivotable so that their free ends also co-operate with corresponding securing means secured to the front surface of the pocket means to assist in securing the pocket means in position on the interior surface of the front panel.

8. A carrying case according to claim 7 wherein the attachment means comprises a plurality of releasable fabric engaging hooks and co-operating hook receiving fabric.

9. In a carrying case having rectangular planar front and back panels, each having circumscribing, rigid top, bottom and side edges extending towards the other panel to provide, when the panels are in closed position, a completely enclosed interior volume, the front and back panels pivoting about an axis along the junction of the bottom edges between open and closed positions, closure means secured to the top edges of the panels to hold the panels in closed position against unintended opening, and a handle means secured centrally to one of the top edges, the improvement characterized by the front panel being foldable about a fold line parallel to its top and bottom edges and spaced therebetween, this line dividing the front panel into an upper and lower portion, the continuity of each of the side edges of the front panel being broken by a cut at the fold line to form a lower and an upper portion of said side edge and permit folding of this front panel about said line, and a clamp means secured to the lower portion of an exposed side edge of each side of the front panel and positioned to swivel between one position extending across the cut of that side edge to releasably engage an engaging means mounted on the upper portion of that side edge of the front panel and a second position extending to the corresponding side edge of the back panel to releasably engage an engaging means mounted on said side edge of the back panel, the clamp means, front panel side edge mounted engaging means and cut of the front panel side edge being such that when the clamping means engages this side edge mounted engaging means the front panel maintains its planar shape and is prevented from folding, and the clamp means and back panel side edge mounted engaging means being such that when the clamp means engages this engaging means, the lower portion of the front panel is held in closed position with respect to the back panel but the upper portion of the front panel is free to fold thereby providing access to the interior volume of the carrying case, the case being also provided with support means associated with the upper portion of the front panel, the support means to co-operate with the back panel to maintain the upper portion of the front panel folded at a predetermined angle with respect to the lower portion.

10. A carrying case according to claim 9 wherein a pocket means having a rear surface is provided for the interior surface of the front or back panels, the inner surface of the front and back panels and the rear surface of the pocket means being provided with means for releasably attaching the pocket means at predetermined areas on the interior surfaces of the front or back panels.

11. A carrying case according to claim 9 wherein the fold line of the front panel is centrally positioned on the panel between the top and bottom edges.

12. A carrying case according to claim 11 wherein the support means comprises a support strap pivotally secured to the interior surface of each side edge of the upper portion of the front panel, the free end of each support strap having securing means co-operating with corresponding securing means secured to the interior surface of the side edges of the back panel to releasably secure the straps thereto, the support straps being pivotable so that their free ends also co-operate with corresponding securing means secured to the front surface of the pocket means to assist in securing the pocket means in position on the interior surface of the front panel.

* * * * *